US006271741B1

(12) United States Patent
Sajna

(10) Patent No.: US 6,271,741 B1
(45) Date of Patent: Aug. 7, 2001

(54) ROTARY INDUCTIVE COUPLING

(75) Inventor: Jeffrey L. Sajna, St. Charles, IL (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/356,789

(22) Filed: Jul. 20, 1999

(51) Int. Cl.[7] ..... H01F 27/36
(52) U.S. Cl. ..... 336/84 M; 336/120
(58) Field of Search ..... 336/117, 118, 336/119, 120, 178, 84 CM

(56) References Cited

U.S. PATENT DOCUMENTS 3,872,334 * 3/1975 Loubier ..... 310/43
3,924,174 * 12/1975 Fahrner ..... 336/117
4,259,603 * 3/1981 Uchiyama et al. ..... 310/112
4,514,645 * 4/1985 Endo et al. ..... 307/10.1
5,347,256 * 9/1994 Yumiki et al. ..... 336/84 C
5,856,710 * 1/1999 Baughman et al. ..... 307/10.1

FOREIGN PATENT DOCUMENTS 55-23712 * 2/1980 (JP) .

* cited by examiner

*Primary Examiner*—Lincoln Donovan
(74) *Attorney, Agent, or Firm*—Roger A. Johnston

(57) ABSTRACT

A rotary transformer having a stator and rotor each formed by winding a coil on a non-magnetic bobbin and overmolding the bobbin and coil with magnetically permeable particulate material dispersed in a non-magnetic medium preferably selected from the group consisting of thermoplastic, thermosetting plastic and thermoplastic elastomer.

8 Claims, 3 Drawing Sheets

22
20
22
24
28
27
26
30
18
10
12
14
16

Fig.6
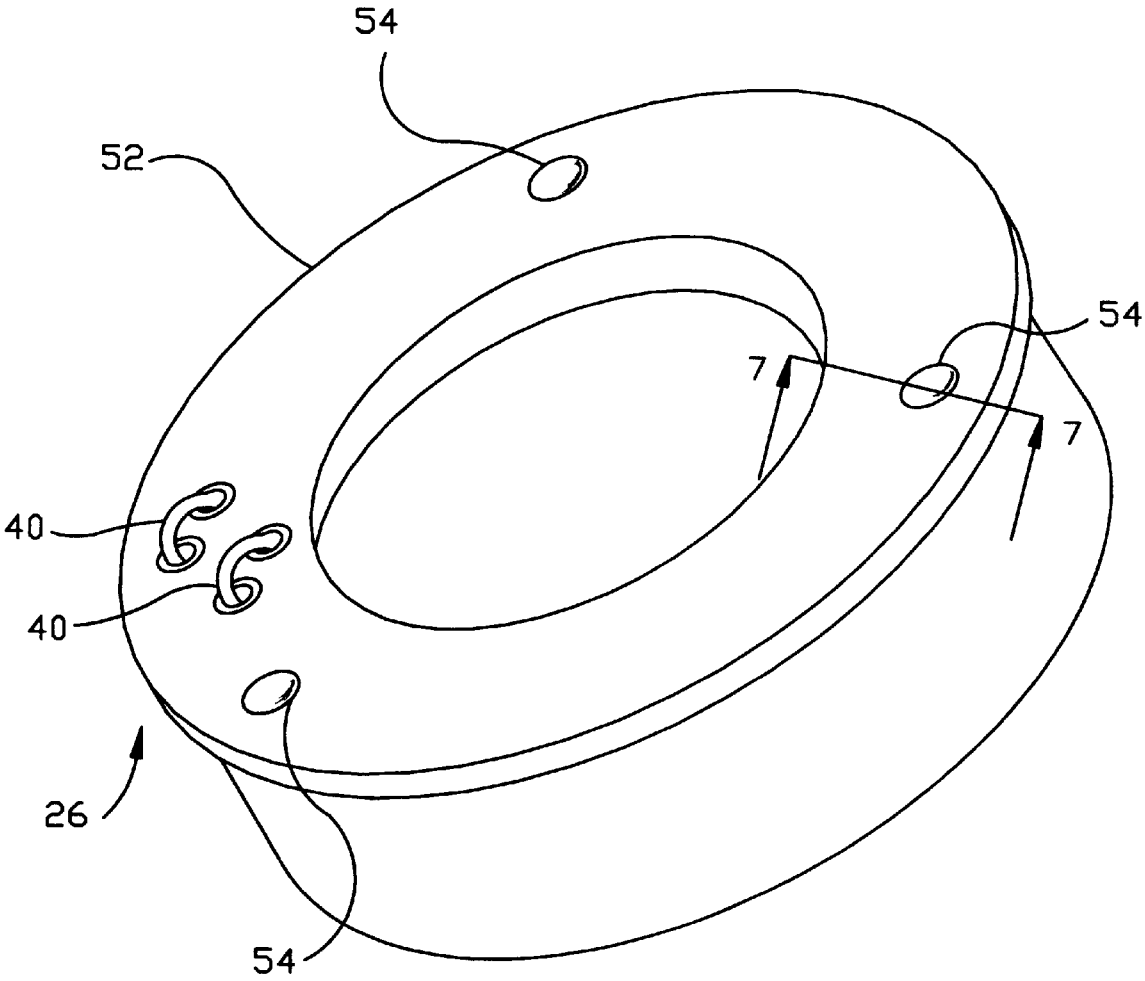
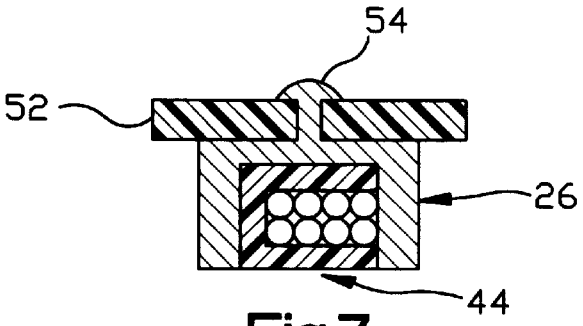
Fig.7

ROTARY INDUCTIVE COUPLING

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to rotary electrical couplings and in particular rotary inductive couplings for transmitting a low level electrical signal and/or an electrical power signal across a rotating junction.

Rotary couplings are useful where it is desired to conduct electrical signals from a stationary to a rotating member or as between two relatively rotating members.

In motor vehicles it has been the practice to provide slip rings, rotary wiper contacts or a ribbon of parallel electrical conductors with the ribbon spirally wound in the form of a "clock spring" for electrically connecting accessory switches and the vehicle horn button in addition to supplying the energy to the steering wheel mounted airbag inflator for effecting inflation in a steering column/steering wheel air bag installation. However, slip rings, wipers and clock spring conductors have proven to be noisy, costly and extremely difficult to assemble for high volume mass production of vehicles. Therefore, it has been desired to provide a relatively frictionless, simpler and lower cost alternative for connecting electrical controls and devices mounted on the steering wheel to the vehicle wiring harness.

BRIEF SUMMARY OF THE INVENTION

The present invention provides a solution to the above-described problem of providing an electrical coupling for a rotary junction and employs an inductive coupling comprising a transformer having one coil or stator stationary with the other coil or rotor relatively rotatable with respect to the stationary coil. The rotary transformer coupling of the present invention is particularly suitable for providing an electrical coupling across the junction of an automotive steering wheel and the steering column to provide electrical connection of the switches and accessories mounted on the steering wheel to the vehicle circuitry; and, its construction is relatively low in manufacturing cost.

The rotary transformer of the present invention has a coiled conductor wound on a bobbin which is subsequently overmolded or inserted into a magnetically permeable material dispersed in a non-magnetic medium to form an annular stator. A second coiled conductor is wound on a second bobbin and subsequently overmolded with magnetically permeable material disbursed in a non-magnetic medium to form an annular rotor.

Alternatively, the magnet wire may have a heat bondable jacket or coating enabling the wire to be wound on a mandrel to form a coil, the mandrel removed and the wire coating heat fused to form a free standing coil, thereby eliminating the bobbin. The stator and rotor are disposed coaxially in side-by-side arrangement to form a transformer. In a steering column application, the stator is mounted on the column and the rotor mounted on the steering wheel. The stator and rotor have a particularly high density of magnetic permeability for the volume of the stator and rotor and thus enables the transformer of the present invention to be employed in a motor vehicle steering column application where it is required to transmit substantial current at the vehicle power supply voltage, typically 12 volts, for providing the current to activate the firing squib in the airbag inflator.

The rotary transformer of the present invention in one embodiment has a plurality of axially extending projections molded integrally with the magnetically permeable material in the non-magnetic medium on either the stator or the rotor; and, a circuit board having cut-outs therein is received over the projections and retained thereon for providing associated electrical componentry utilized in the application with the transformer. The transformer of the present invention thus is easily manufactured at a relatively low cost and is compact and provides a high efficiency or magnetic density inductive coupling and can provide the requisite current carrying capacity needed for an automotive steering column airbag inflator application.

BRIEF DESCRIPTION OF THE DRAWINGS

FIG. 6 is a perspective view of the embodiment of FIG. 4 with a circuit board attached; and, FIG. 7 is a section view taken along section indicating lines 7—7 of FIG. 6.

DETAILED DESCRIPTION OF THE INVENTION

Figure 1:
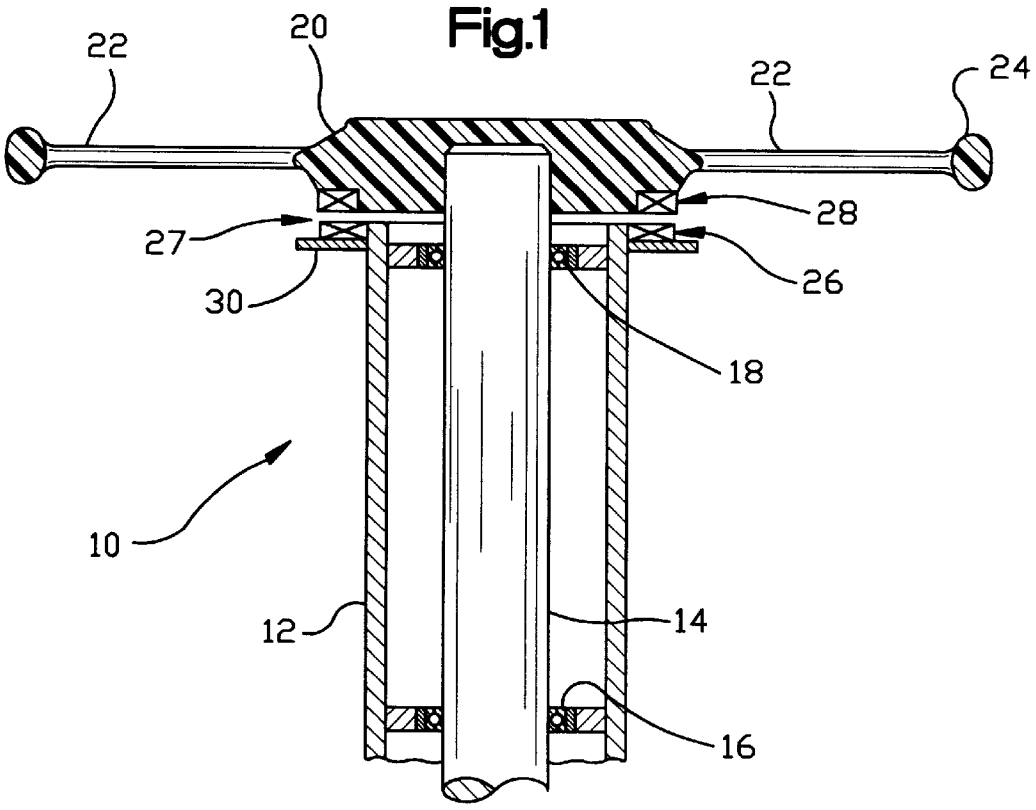
FIG. 1 is a cross-section of an automotive steering column assembly with the transformer of the present invention installed thereon.
Figure 3:
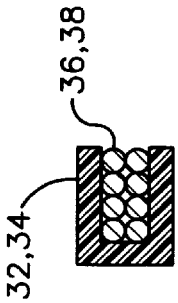
FIG. 3 is a cross-section taken along section indicating lines 3—3 of FIG. 2.

Referring to FIG. 1, steering wheel assembly for a motor vehicle is indicated generally at 10 and includes a steering column tube or casing 12 having a steering shaft 14 received therethrough and journalled for rotation therein in bearings 16, 18 provided in the interior of column casing 12. A steering wheel hub 20 is mounted over the upper end of shaft 14 which extends axially beyond casing 12 and is connected to a plurality of spokes 22 and an outer annular rim 24.

An annular stator, indicated generally at 26, is disposed on the end of the casing 12 adjacent the hub 20. An annular rotor, indicated generally at 28, is disposed closely spaced adjacent stator 26; and, rotor 28 is mounted on the underside of the steering wheel hub 20. The stator and rotor provide an inductive coupling between the steering column casing 12 and steering wheel hub 20 in the form of a rotary transformer indicated generally at 27. In the presently preferred practice, stator 26 has an annular circuit board 30 attached thereto as will be hereinafter described in greater detail.

It will be understood that the rotor 28 may be electrically connected to a desired functional element on the steering wheel as, for example, an airbag inflator firing squib (not shown) or an accessory control switch (not shown) such as commonly used for controlling a horn or a cruise control.

Referring to FIGS. 2 through 5, a first and second bobbin 32, 34 of non-magnetic material are commonly illustrated as having a conductive coil 36, 38 preferably of magnet wire wound therearound with the ends 40, 42 thereof extending outwardly of the bobbin for electrical connection thereto. The commonly illustrated coil assembly is indicated generally at 44, 46 in FIG. 2. In the presently preferred practice, the coil bobbins 32, 34 are preferably formed of non-magnetic material which is also dielectric.

Figure 2:
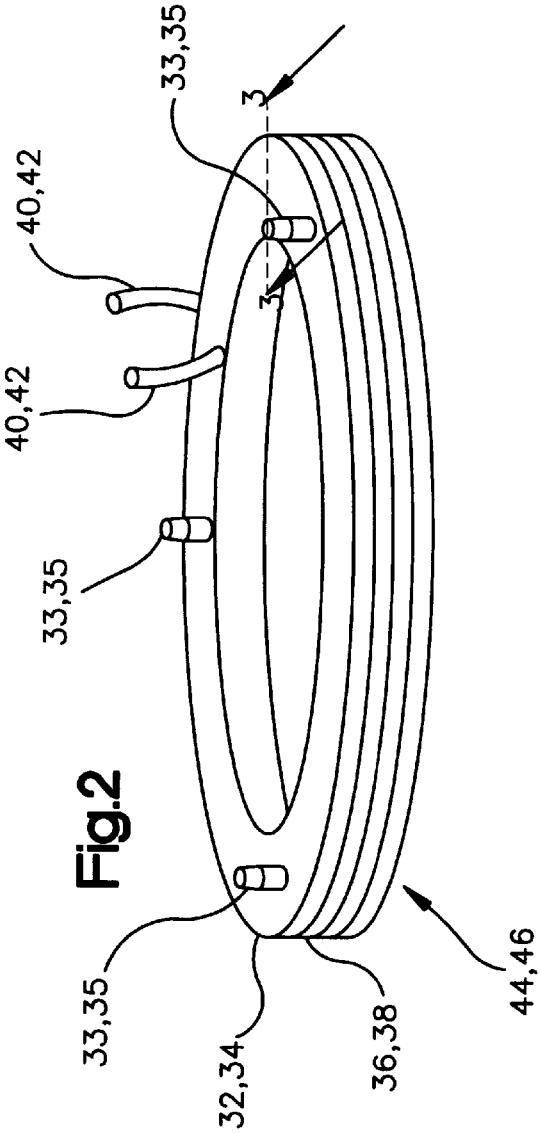
FIG. 2 is a perspective view of the bobbin and coil typical of the stator and rotor of the present invention.
Figure 4:
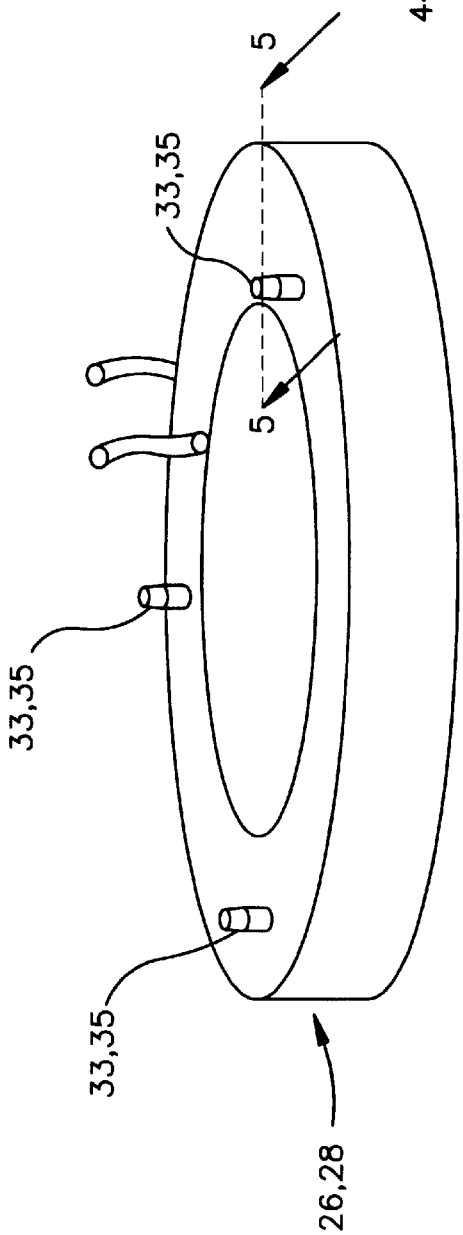
FIG. 4 is a perspective view of the overmolded bobbin and coil of FIG. 2 for the stator and rotor of the present invention.

Referring to FIG. 4, the coil assembly 44, 46 of FIG. 2 has been inserted into a mold (not shown) and overmolded with magnetically permeable material disbursed in a non-magnetic medium, such as, for example, ferrite powder disbursed in a material preferably selected from the group consisting of thermoplastic, thermosetting plastic and thermoplastic elastomer. It will be understood however that other materials may be employed for the non-magnetic medium, for example ceramic material. Preferably the magnetically permeable material is in particulate, granular or powder form uniformly disbursed throughout the non-magnetic medium. The overmolded coil assembly 44, 46 is removed from the mold and formed as the stator 26 and rotor 28 as indicated generally in FIG. 4.

Alternatively, the magnet wire may be coated with heat bondable material and the coil wound on a mandrel, the mandrel removed and the wire coating heat fused to form a free standing coil which may then be overmolded without a bobbin. For very low power transmission applications the overmolding may be eliminated. However, it will be understood that overmolding with the magnetically permeable material to form the illustrated stator 26 and rotor 28, provides greater flux concentration and efficiency for applications requiring any significant power transmission.

With reference to FIG. 2, the bobbin 32, 34 for one of the stator 26 or rotor 28 has provided on one axial face thereof at least one, and preferably a plurality of, axially extending projections or lugs 33, 35 preferably disposed in circumferentially equally spaced arrangement.

Figure 5:
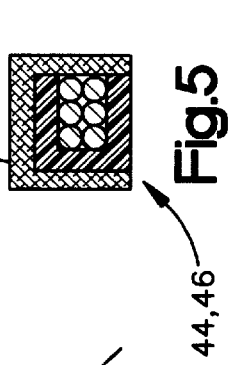
FIG. 5 is a section view taken along section indicating lines 5—5 of FIG. 4.

Referring to FIG. 5, the overmold is shown as having a generally inverted U-shaped configuration and denoted by reference numerals 48, 50.

Referring to FIG. 6, the preferred form of the stator 26 is indicated as having an annular circuit board 52 mounted over the lugs 33 which are then deformed, as for example, by heat staking as denoted by reference numeral 54 for retaining the circuit board on the axial face of the stator 26. It will be understood that the electrical leads are received through appropriate apertures provided in the circuit board and the ends thereof attached to the desired connection terminals (not shown) provided on the circuit board 52.

The stator 26 with circuit board 52 attached thereto is then mounted on the steering casing as shown in FIG. 1; and, the rotor 28 is mounted on the steering wheel as shown in FIG. 1.

The present invention thus provides a unique and novel way of providing a rotary transformer for an electrically inductive coupling across a rotating junction and provides a rotary transformer which is high in its magnetic density with a minimum volume and which is easy to fabricate and low in manufacturing cost and is particularly suitable for an automotive steering wheel application.

Although the invention has hereinabove been described with respect to the illustrated embodiments, it will be understood that the invention is capable of modification and variation and is limited only by the following claims.

What is claimed is:

1. A rotary inductive electrical coupling comprising:

(a) a first bobbin formed of non-magnetic material;

(b) a first coil of electrically conductive material wound on said first bobbin;

(c) a stator formed of magnetically permeable material dispersed in a non-magnetic medium molded over said first bobbin and first coil;

(d) a second bobbin formed of non-magnetic material having a second coil of electrically conductive material wound thereon; and, (e) a rotor formed of magnetically permeable material dispersed in a non-magnetic medium molded over said second bobbin and second coil, wherein said rotor and stator have an annular configuration and are disposed in axially spaced side-by-side arrangement with respect to the axis of said first and second coil with the rotor rotatable with respect to the stator.

2. The coupling defined in claim 1, wherein:

(a) one of the rotor and the stator has at least one projection molded integrally thereon; and, (b) a circuit board is disposed adjacent either one of said stator and rotor and has said at least one projection received therethrough for retaining said circuit board attached to said one stator.

3. The coupling defined in claim 1, wherein said non-magnetic medium comprises resinous material selected from the group consisting of:

(a) thermoplastic, (b) thermosetting plastic, and (c) thermoplastic elastomer.

4. The coupling defined in claim 1, wherein either one of said rotor and stator has a plurality of projections molded integrally thereon with a circuit board disposed adjacent said one of said stator and rotor with said projections received through said circuit board and retaining said board on said one stator.

5. The coupling defined in claim 1, wherein said magnetically permeable material comprises particulate ferrite material dispersed in a thermoplastic medium.

6. The coupling defined in claim 1, wherein said first and second coils each have the ends thereof extending through their respective bobbins and magnetically permeable material and externally thereof for electrical connection thereto.

7. The coupling defined in claim 1, wherein one of said rotor and stator has a plurality of projections formed thereon and extending axially therefrom in circumferentially spaced arrangement with a circuit board having apertures therein disposed with said projections received in said apertures and secured thereon.

8. The coupling defined in claim 1, wherein said first and second bobbins are formed of non-magnetic material which is dielectric.

* * * * *